United States Patent [19]

Forrest et al.

[11] 4,446,944

[45] May 8, 1984

[54] SHOCK ABSORBING DEVICE AND METHOD

[75] Inventors: William E. Forrest; Frank R. Lupton, both of Denver, Colo.

[73] Assignee: Forrest Mountaineering, Inc., Denver, Colo.

[21] Appl. No.: 473,577

[22] Filed: Mar. 9, 1983

[51] Int. Cl.[3] ..... A62B 35/00

[52] U.S. Cl. ..... 182/3

[58] Field of Search ..... 182/3–7

[56] References Cited

U.S. PATENT DOCUMENTS

| | | | |
|---|---|---|---|
| 2,441,209 | 5/1948 | Rose . | |
| 2,459,545 | 1/1949 | Schultz | 182/3 |
| 3,444,957 | 5/1969 | Ervin, Jr. . . | |
| 3,804,698 | 4/1974 | Kinloch . | |
| 4,100,996 | 7/1978 | Sharp | 182/3 |
| 4,253,544 | 3/1981 | Dalmaso . | |

*Primary Examiner*—R. P. Machado
*Assistant Examiner*—Alvin Chin-Shue
*Attorney, Agent, or Firm*—Fields, Lewis, Pittenger & Rost

[57] ABSTRACT

A shock absorber has been provided for absorbing the kinetic energy of a falling body wherein a series of variable length shock absorbing straps made of undrawn nylon are attached to a longer back-up strap made of non-stretchable material and are folded back and forth upon themselves and contained within an abrasive resistant package. The energy absorbing straps can be treated with ethylene glycol to prevent freezing and can be covered with petroleum jelly to prevent both the escape and entry of moisture and to prevent the evaporation of the ethylene glycol. In addition, a plastic liner can be placed around the assembly and the covering for the assembly can be provided with a waterproof coating to further minimize the evaporation of moisture and ethylene glycol within the strap assembly and to prevent entry of additional moisture. The cover is arranged to tear away when a force is applied by a falling body to the shock absorber greater than a minimum predetermined value so that the energy absorbing straps can be serially stretched to absorb the kinetic energy of the falling body.

14 Claims, 7 Drawing Figures

SHOCK ABSORBING DEVICE AND METHOD

DESCRIPTION

1. Technical Field

This invention relates to a shock absorber, but more particularly to an energy absorbing device and method for absorbing kinetic energy generated by a falling body. The shock absorber is altered during use and therefore is intended for one-time use for absorbing the kinetic energy developed by a falling body.

2. Background Art

A great number of shock absorbing devices and methods of absorbing energy have been developed for a variety of usages. In most instances, shock absorbing devices are developed for specific types of loading and are not intended for other purposes. One specialized area in which the effectiveness of a shock absorbing device can literally mean the difference between life and death is in technical mountain climbing or rock climbing. Although some of the same considerations are involved with respect to providing shock absorbing devices for window washers or persons working on high buildings or other high places, there generally is one significant difference. In technical mountain climbing or rock climbing, the ultimate force which the anchoring point, usually a piton or climbing nut can withstand is not known. The reason this is true is because the strength of the rock in which the piton or climbing nut is anchored is always uncertain. Therefore, the more total force which will be applied to the anchor at any one time can be maintained below certain relatively low levels, the better chance the anchor will not fail. Although most shock absorbers are satisfactory for their intended purpose, they do not provide serially arranged shock absorbing devices for keeping the force exerted on the anchor point below a pre-determined level.

U.S. Pat. No. 2,441,209 to Rose discloses the use of undrawn nylon as a shock absorber. U.S. Pat. No. 3,444,957 to Ervin, Jr. discloses a shock absorber having a strap which is folded back and forth upon itself and wherein the overlapping reaches are sewed together. The kinetic energy developed by a falling body is absorbed by the breaking of the stitching between the overlapping reaches of the belt webbing. The overlapping reaches of webbing are enclosed in a protective covering. U.S. Pat. No. 3,804,698 to Kinloch discloses a reusable shock absorbing device wherein a short tear strap is elongated when under above normal tensile load and if torn away is backed up by a back-up strap which absorbs the remainder of the kinetic energy. U.S. Pat. No. 4,100,996 to Sharp discloses a shock absorbing device having a slide fastener wherein the friction generated as the webbing moves through this slide fastener absorbs the kinetic energy of a falling body. U.S. Pat. No. 4,253,544 to Dalmaso discloses a shock absorbing device wherein stitching tears apart to absorb the kinetic energy caused by the falling body.

DISCLOSURE OF THE INVENTION

In accordance with this invention, a shock absorber for gradually absorbing the kinetic energy of a falling body, wherein the damage to the falling body, anchor point and equipment is minimized, includes a shock absorber support means having at least a first energy absorbing strap with a reach of pre-determined length and made of a webbing material which is stretchable when a load applied to it exceeds a pre-determined value, but does not rebound when the load is decelerated, the first strap having a first end and a second end and an elastic limit to which it can be stretched. The back-up strap is also included which has a longer reach than the first energy absorbing strap and is made of substantially non-stretchable webbing capable of transmitting any unabsorbed kinetic energy to the climbing rope and of supporting the body after the shock absorber support means has been stretched to its elastic limit, the back-up strap having first and second ends each formed as a support loop. Means are fixedly connected to the first and second ends of the first strap and to the first and second ends of the backup strap, the back-up strap being folded back and forth upon itself between the support loops. Finally, there is means provided for holding the back-up strap in folded position adjacent the first strap, the holding means being releasable when the kinetic energy applied to the falling body exceeds a pre-determined value.

More particularly, the shock absorber support means includes a plurality of energy absorbing straps each having a reach of greater length than the first energy absorbing strap and of lesser length than the back-up strap and each energy absorbing strap being of a different length and arranged serially so that as the first energy absorbing strap reaches its elastic limit, the next longer strap begins to stretch and absorb additional kinetic energy and so on until all of the kinetic energy is absorbed.

It has been found that a suitable material for the energy absorbing straps is unstretched virgin nylon whereas a suitable material for the back-up strap is Kevlar, a product of E. I. duPont de Nemours and Company of Wilmington, Del. The longer straps are folded back and forth upon themselves and the energy absorbing straps are treated with ethylene glycol and then coated with petroleum jelly and sealed in a plastic membrane. The plastic membrane is then protected by a fabric covering which has waterproofing on the inner surface thereof. Conveniently, the cover can be stitched to the webbing and will tear away when a force is applied to the shock absorber above a pre-determined level wherein the shock absorber begins to stretch to absorb the kinetic energy of the falling body.

The shock absorber of this invention is of relatively simple, yet highly efficient construction and is designed to be activated at a pre-determined minimum force, but not to apply a force above a higher pre-determined limit so that the total force applied both to the falling body and to the anchor point is sufficiently low that the possibility of the anchor coming out or of the falling body becoming injured are substantially reduced.

Additional advantages of this invention will become apparent from the description which follows, taken in conjunction with the accompanying drawings.

BRIEF DESCRIPTION OF THE PREFERRED EMBODIMENT

Figure 2:
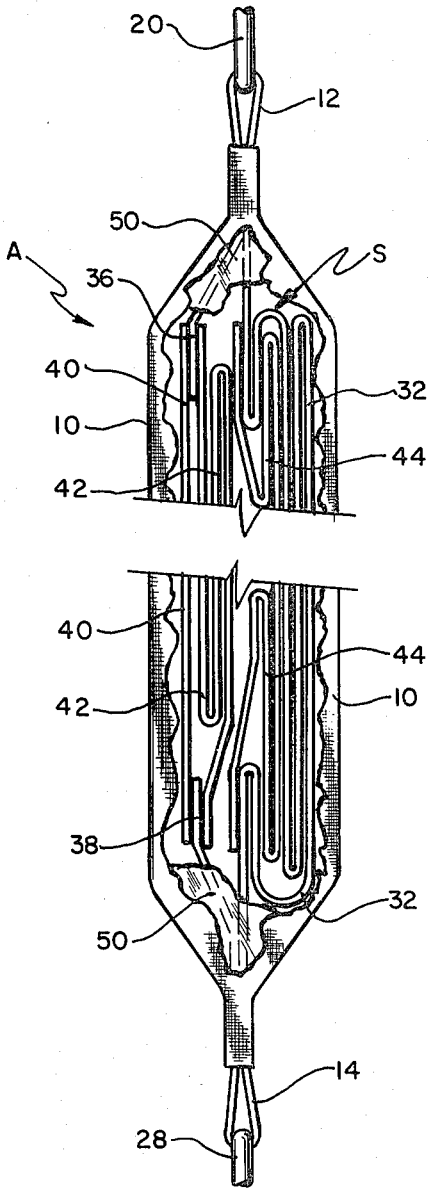
FIG. 2 is a fragmentary side elevation of the shock absorber of FIG. 1 with parts broken away for clarity of illustration, showing the manner the energy absorbing straps and back-up strap are interconnected and folded within the cover.
Figure 1:
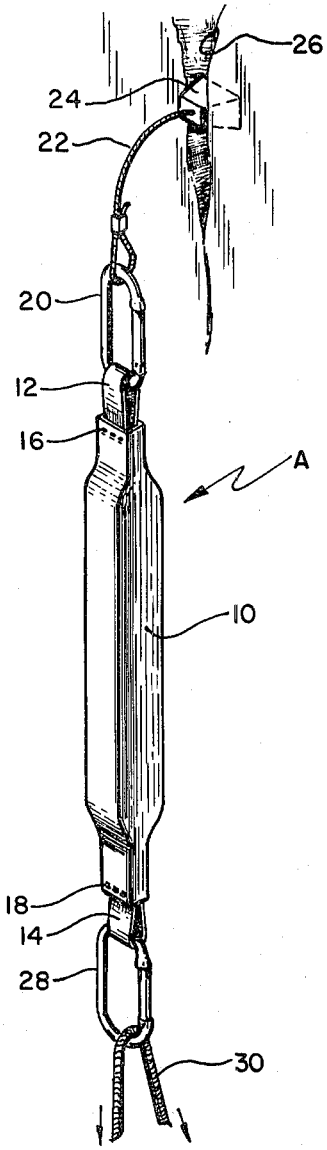
FIG. 1 is a perspective view of a shock absorber constructed in accordance with this invention being supported for use by a climbing nut in a crack in a rock face.
Figure 3:
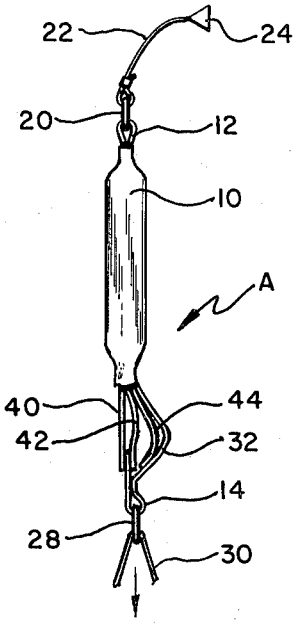
FIG. 3 is a diagrammatic side elevation of the shock absorber of FIG. 1 wherein the kinetic energy of a falling body is being absorbed by the shortest strap.
Figure 4:
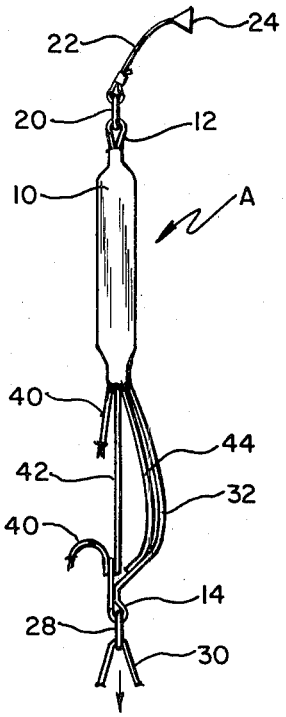
FIG. 4 is a diagrammatic side elevation, similar to FIG. 3, but showing the kinetic energy of a falling body being absorbed by the second shortest strap after the first has failed.
Figure 5:
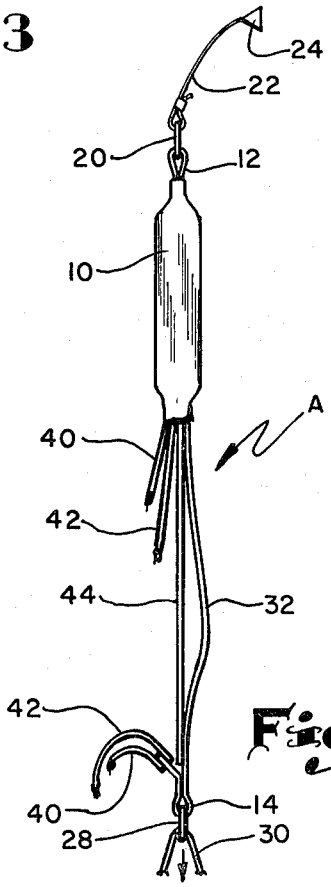
FIG. 5 is a diagrammatic side elevation, similar to FIG. 3, but showing the kinetic energy of a falling body being absorbed by the third shortest strap after the first and second straps have failed.
Figure 6:
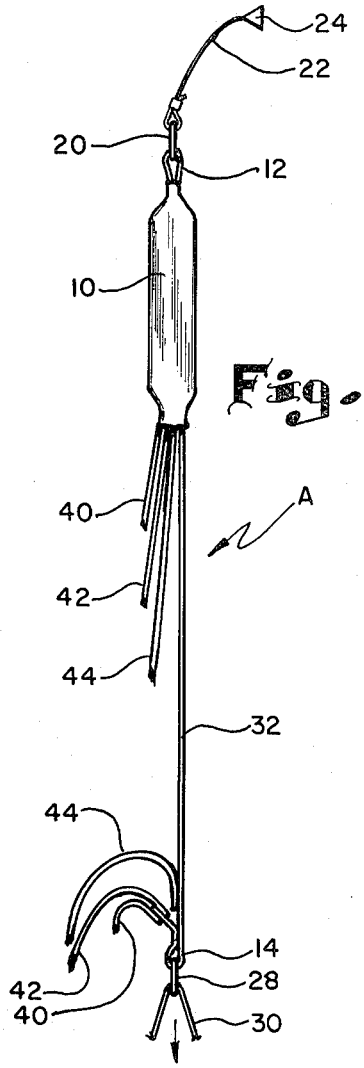
FIG. 6 is a diagrammatic side elevation showing the shock absorber after all of the shock absorbing straps have failed and the load is being supported by the back-up strap.

In accordance with this invention, a shock absorber A is provided which includes a plurality of energy absorbing straps, as explained more fully below, which are enclosed in an envelope or cover 10. Cover 10 is sewed at its ends to an upper support loop 12 and a lower support loop 14 as by stitching 16 and 18, respectively. Conveniently, a carabiner 20 supports the shock absorber from upper support loop 12 and in turn is supported by a cable 22 connected to climbing nut 24 which is wedged into a crack 26 in a rock face. It will be understood that the climbing nut 24 is shown for purposes of illustration only and other anchoring devices, such as pitons, can be used depending upon the characteristics of the surface over which the climb is being made.

A second carabiner 28 is attached to lower support loop 14 through which a climbing rope 30 extends which is connected to the load to be supported and protected. In most instances, this load will be a human body and the climbing rope will be attached to a climbing harness (not shown) which the climber is wearing. However, it should be understood that the shock absorber of this invention can be used with any load which could be subject to damage or destruction if the forces exerted upon the load were excessive. Back-up strap S is the basic element of shock absorber A to which all of the other elements are connected. Back-up strap S has a long reach 32 which normally is folded back and forth upon itself within cover 10 as shown in FIG. 2. This strap may be made of any suitable high strength material. A material which has been found to be particularly useful is Kevlar, a product made by duPont which is one inch wide webbing, and has a six thousand pound test strength. Dacron or nylon can also be used, but they are heavier and only test in this construction at about eight hundred pounds.

Figure 7:
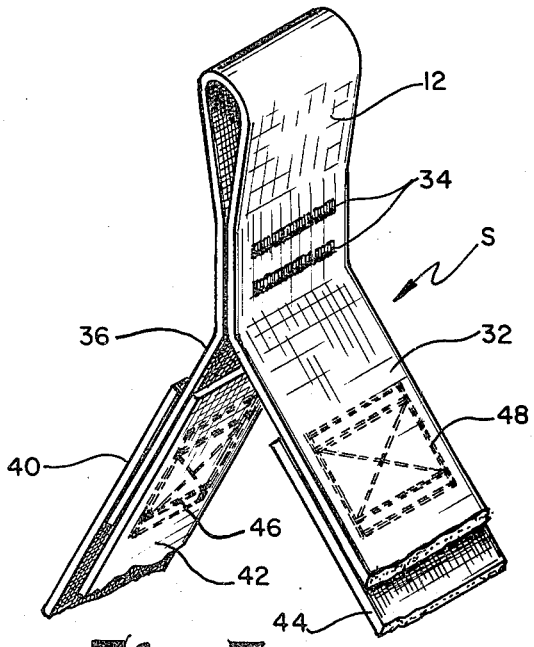
FIG. 7 is a fragmentary, enlarged, perspective view showing the manner in which the energy absorbing straps are connected to the back-up strap.

As best seen in FIG. 7, upper loop 12 is formed in strap S by folding the strap adjacent the upper end thereof and sewing parallel rows of stitching 34 thereacross leaving a depending upper end 36. The reach 32 is folded over adjacent the other end to form loop 14 with similar parallel rows of stitching (not shown) resulting in a lower extending end 38. This back-up strap S in addition to supporting the shock absorbing straps to be described, also serves as an ultimate safety support for the falling body or load attached to climbing rope 30.

As best seen in FIG. 2, the energy absorbing straps comprise three straps of different lengths. A short strap 40 has an upper end attached to one side of end 36 of back-up strap S and a lower end connected to one side of the lower end 38 of back-up strap S. An intermediate length strap 42 has its upper end attached to the opposite side of end 36 of back-up strap S and its lower end attached to the opposite side of lower end 38 of back-up strap S. Since this strap 42 is longer, it must be folded back and forth upon itself a couple of times as shown. Finally, a third long energy absorbing strap 44 is provided whose upper end is attached to reach 32 below loop 12 and whose lower end is attached to reach 32 above loop 14. This strap is folded back and forth a number of times and is interlaid within the folds of reach 32.

An important characteristic of energy absorbing straps 40, 42 and 44 is that they stretch when placed under impact loads of predetermined magnitude, but do not spring back after the energy is absorbed. It is highly undesirable that the falling body bounce up and down in the manner of a yo-yo as such a bouncing action will place unwanted stresses on the carabiners, the cable and particularly on the climbing nut or piton which is normally anchored in rock or ice. In other words, if this bouncing or yo-yo action can be avoided, the chances of safely stopping the falling body are increased substantially.

A very suitable material for this purpose has been found to be undrawn synthetic plastic fibers such as nylon polyethylene. These are synthetic plastic fibers in their virgin extruded state prior to having the strecth removed. Advantageously, the undrawn synthetic fibers can be woven into straps or webbing of suitable size for use as straps 40, 42, and 44, undrawn nylon having been found to be very suitable for the purposes of this invention. Since webbing formed of undrawn nylon contains moisture within it, it must be protected from freezing and from evaporation. Otherwise it would become stiff and brittle and would not function effectively.

To prevent freezing, the webbing which has been made from the undrawn nylon is in rolls which are soaked for about twenty-four hours in a barrel of ethylene glycol and then allowed to drip dry for another period of approximately twenty-four hours. As is well understood, the ethylene glycol combines with the water molecules in the webbing material to substantially reduce the freezing temperature of the water. Combined with the anti-freeze action of the ethylene glycol on water absorbed into the polymer matrix, the plasticity, and therefore the ability of the polymer chains to slide past one another without breaking will be maintained. Then the product is ready to be cut to suitable lengths and sewed into the product as shown in the drawings.

Advantageously, the straps 40, 42 and 44 are each attached to back-up strap S, as by box-x stitches 46 and 48 shown in FIG. 7. The advantage of the box stitches is that the stitches are widely spaced so that they do not sever the fibers of the undrawn nylon straps. Of course, it will be understood that a stitch other than a box stitch could be used so long as the spacing of the stitches is relatively wide. These box stitches can be contrasted with stitching 34 in the Kevlar back-up strap where the stitching is very close together.

After the strap assembly has been sewn together, it must be protected so that the moisture in the webbing of straps 40, 42 and 44, which is made from the undrawn nylon, will not evaporate. Furthermore, it is also desirable to keep additional moisture out. It has been found that if the undrawn nylon is submitted to wet or humid conditions at a temperature between 122° F. and 194° F. the undrawn nylon will deteriorate in a matter of days. This can be overcome by excluding moisture and/or treating the undrawn nylon with 8-hydroxyquinoline. Therefore, the straps must be coated with a suitable sealer. A suitable sealer has been found to be petroleum jelly which can be applied by spreading it over the surface of the webbing so that the webbing is completely covered. Thereafter, the straps are folded into the position shown in FIG. 2. They can be held in this position for the remainder of the assembly process by any sort of holding means, such as one or more rubber bands (not shown) placed around the assembly. To further assure that evaporation of the water molecules in the undrawn nylon does not occur, the assembly may be covered with a thin plastic membrane 50. A suitable material for this is Saran wrap which is also a product of the E. I. duPont de Nemours and Company of Wilmington, Del. Finally, the cover or sheet 10 which is made of any lightweight abrasion resistant material, such as brushed nylon fabric has a waterproof coating on its inner surface which serves as a final and third moisture barrier. The cover is wrapped around the strap assembly and sewn longitudinally (not shown) and sewn across its ends in stitching 16 and 18 which substantially contains the moisture and petroleum jelly within the sheath or cover 10. The cover is also opaque to keep light off of the undrawn nylon since extended exposure to light over a period of time will cause the undrawn nylon to deteriorate.

The parameters used to design the straps for use in this shock absorber were designed so that a falling body weighing one hundred seventy-six pounds which was subjected to a free fall of up to sixteen feet before the shock absorber became effective would apply a force to the falling body in the approximate range of five hundred pounds to nine hundred pounds depending on ambient temperature variations. The system was also designed so that the shortest strap would begin to stretch when the force exerted upon it was between three hundred fifty pounds and four hundred pounds of force. This will occur with respect to a one hundred seventy-six pound body when it falls approximately six inches.

Through empirical testing, it has been found that a webbing having eighty to ninety-five longitudinal strands provides the appropriate resistance to meet these criteria. Each strand is 0.103 inches in diameter. Each of these strands runs all the way from one end of the strap to the opposite end so that the force is applied equally to all eighty-one strands. The transverse or warp threads in the webbing have a diameter of 0.006 inches. The thickness of both the strands and the threads can vary by plus or minus 0.002 inches. Also, the number of strands can be varied to change the loading on the system as desired for particular applications and as will be apparent to one skilled in the art.

As will be apparent, when a body falls if the force exerted by that body exceeds three hundred fifty to four hundred pounds of force, the shortest most strap 40 will begin to stretch and to absorb energy from the falling body. As strap 40 stretches and the resiliency is removed from it, its ability to absorb additional energy will decrease. Therefore, before the strands in strap 40 are completely stretched, the second or intermediate strap 42 must begin to stretch and absorb energy. At the point where this occurs, the force exerted by the first strap will be approaching the maximum desirable force of seven hundred pounds. The force exerted on the body will remain at approximately seven hundred pounds until all of the kinetic energy has ultimately been absorbed through the stretching of the successive straps. If the kinetic energy being exerted by the body is so great that the intermediate strap 42 cannot absorb all of the energy, before it reaches the end of its stretching ability, the longest energy absorbing strap 44 will begin to stretch. Of course, the shorter straps will ultimately rupture if they are unable to absorb all of the kinetic energy. The system is designed to absorb all of the energy at least prior to the full stretching of the longest energy absorbing strap 44. However, should this strap also become completely stretched, the remainder of the kinetic energy will be transmitted by back-up strap S to climbing rope 30.

As can be seen, the relative lengths of the straps are also important in order to be sure that each succeeding strap begins to absorb energy prior to the rupture of the proceeding strap. In this regard, the effective lengths of the straps between stitching 34 and the upper and lower loops 12 and 14 is five inches for strap 40, fifteen inches for strap 42, twenty-three inches for strap 44 and seventy-six inches for back-up strap S when the number of strands is between eighty and ninety-five, as discussed above.

From the foregoing, the advantages of this invention are readily apparent. A shock absorber has been provided which includes a plurality of energy absorbing straps of varying length wherein the kinetic energy created by a falling body will initially be absorbed by the shortest of the straps and if that strap cannot absorb all of the kinetic energy, additional kinetic energy will be absorbed by each succeeding strap keeping the force exerted on the falling body within specified pre-determined limits. Furthermore, a back-up strap is provided which will transmit any remaining kinetic energy to the climbing rope which is not ultimately absorbed by the energy absorbing straps prior to their respective rupture.

The energy absorbing straps are made of undrawn nylon which preferably has been soaked in ethylene glycol to prevent the straps from freezing in cold weather. The moisture in the straps and ethylene glycol is kept from evaporating by painting or covering the outsides of the undrawn nylon energy absorbing straps with petroleum jelly. The strap assembly is arranged so that the longer straps are folded back and forth upon themselves and the entire assembly is sealed in a protective plastic coating as well as in a protective covering having a waterproof lining to minimize any evaporation of the water or ethylene glycol from the energy absorbing straps.

It will be understood that the embodiment disclosed has been found effective for use by a mountain climber of average weight and carrying standard gear and is useful in a variety of environmental conditions. However, it is apparent that variations in construction can be made for use with different types of loads and under different environmental conditions. Thus, either a lesser or greater number of energy absorbing straps can be used, as may be required and apparent to one skilled in the art. Also, the lengths of the straps may vary and the number of energy absorbing straps which are effective at any one time may vary to alter the energy absorbing characteristics of the shock absorber.

The term "strap" as used herein is not intended to be limited to a webbing, but can also include a rope or any other configuration wherein the strands extend longitudinally through the entire length of the energy absorbing member.

The invention has been described in detail with particular reference to preferred embodiments thereof, but it will be understood that variations and modifications can be effected within the spirit and scope of this invention.

We claim:

1. A shock absorber for gradually absorbing the kinetic energy of a falling body, whereby damage to the falling body is minimized, said shock absorber comprising:

shock absorber support means including a plurality of energy absorbing straps, each energy absorbing strap having first and second ends and being of a different length, said energy absorbing straps being serially arranged so that as the shortest energy absorbing strap reaches its elastic limit the next longer strap tends to stretch and absorb additional kinetic energy and so on until all of the kinetic energy is absorbed;

a back-up strap having a longer reach than the longest of said energy absorbing straps and made of substantially non-stretchable webbing capable of transmitting any unabsorbed kinetic energy and of supporting the body after said shock absorber support means has been stretched to its elastic limit, said back-up strap having first and second ends, each formed as a support loop;

means fixedly connecting said first and second ends of each of said energy absorbing straps to said first and second ends of said back-up strap, said back-up strap being folded back and forth upon itself between said support loops; and means for holding said back-up strap in folded position adjacent said energy absorbing straps, said holding means being releasable when the kinetic energy applied by the falling body exceeds said predetermined value.

2. A shock absorber, as claimed in claim 1, wherein: said holding means is an envelope extending around and enclosing said support means and said back-up straps.

3. A shock absorber, as claimed in claim 2, wherein: said envelope is sewed to said first and second ends of said back-up strap by stitching, said envelope tearing away if the kinetic energy exerted by the falling body exceeds said predetermined value to stretch said first energy absorbing strap.

4. A shock absorber, as claimed in claim 1, wherein: said support means constructed of undrawn virgin nylon fibers.

5. A shock absorber, as claimed in claim 4, wherein: said support means is constructed of Kevlar fibers.

6. A shock absorber, as claimed in claim 4, wherein: said fibers have been treated with ethylene glycol.

7. A shock absorber, as claimed in claim 6, wherein: said holding means is a moisture impervious envelope extending around and enclosing said support means and said back-up strap.

8. A shock absorber, as claimed in claim 7, wherein said envelope includes:

an outer fabric cover; and an inner plastic cover, said envelope being sewed to said first and second ends of said back-up strap by stitching which will break if the kinetic energy exerted by the falling body is sufficient to stretch said support means.

9. A shock absorber, as claimed in claim 7, further including:

a layer of moisture impervious material coated on said nylon fibers.

10. A shock absorber, as claimed in claim 9, wherein: said moisture impervious material is petroleum jelly.

11. A shock absorber for gradually absorbing the kinetic energy of a falling body, whereby damage to the falling body, anchor and equipment is minimized, said shock absorber comprising:

first, second and third energy absorbing webbing straps of successively increasing length and made of undrawn virgin nylon fibers and each having a first end and a second end;

a back-up strap having a longer reach than said longest third energy absorbing strap and made of substantially non-stretchable webbing, said back-up strap having an upper support loop formed adjacent one end as a portion of the strap folded over upon itself and secured together with said one end extending from said upper support loop and having a lower support loop formed adjacent the other end as a portion of the strap folded over upon itself and secured together with said other end extending from the said lower support loop, said first ends of said first and second energy absorbing straps being attached to opposite sides of said one end of said back-up strap and said second ends of said first and second energy absorbing straps being attached to corresponding opposite sides of said other end of said back-up strap and said first end of said third energy absorbing strap being connected to said reach of said back-up strap adjacent said upper support loop and said second end of said third energy absorbing strap being connected to said reach of said back-up strap adjacent said lower support loop;

ethylene glycol absorbed in each of said energy absorbing straps;

petroleum jelly coated on said energy absorbing straps to minimize evaporation of said ethylene glycol;

a water impervious cover enclosing said energy absorbing straps and said back-up strap and holding said second and third energy absorbing straps and said back-up strap in overlapping, folded condition approximately equal in length to said first energy absorbing strap, said cover being sewed at its ends to said upper and lower support loops by stitching so that upon stretching of said first energy absorbing strap said stitching will break; and a plastic covering wrapped around said folded straps within said cover.

12. A shock absorber, as claimed in claim 11, wherein:

said first and second ends of said energy absorbing straps are each sewed to the back-up strap with a box-x stitch.

13. A method of absorbing kinetic energy generated by a falling body to safely terminate the fall of the body and limit the loads to anchors and equipment, said method comprising the steps of:

absorbing the kinetic energy through a series of straps of successively increasing length wherein the force is applied to the shortest strap which is stretched to its elastic limit whereupon the remaining force is applied to the next shortest strap which takes up the load and is stretched and so on until all the kinetic energy is absorbed, said straps being stretchable when a load of predetermined value is applied to them.

14. A method, as claimed in claim 13, wherein:

more than one strap is effective at one time to absorb kinetic energy at least during a portion of the fall of the body.

* * * * *